US009988917B2

(12) United States Patent
Bhaumik et al.

(10) Patent No.: US 9,988,917 B2
(45) Date of Patent: Jun. 5, 2018

(54) BULGED NOZZLE FOR CONTROL OF SECONDARY FLOW AND OPTIMAL DIFFUSER PERFORMANCE

(71) Applicant: General Electric Company, Schenectady, NY (US)

(72) Inventors: Soumyik Kumar Bhaumik, Bangalore (IN); Rohit Chouhan, Bangalore (IN)

(73) Assignee: General Electric Company, Schenectady, NY (US)

( * ) Notice: Subject to any disclaimer, the term of this patent is extended or adjusted under 35 U.S.C. 154(b) by 265 days.

(21) Appl. No.: 14/884,140

(22) Filed: Oct. 15, 2015

(65) Prior Publication Data

US 2017/0107835 A1 Apr. 20, 2017

(51) Int. Cl.
*F01D 9/04* (2006.01)

(52) U.S. Cl.
CPC ..... *F01D 9/041* (2013.01); *F01D 9/047* (2013.01); *F05D 2220/32* (2013.01); *F05D 2240/124* (2013.01); *F05D 2240/128* (2013.01); *F05D 2240/80* (2013.01); *F05D 2250/28* (2013.01); *F05D 2250/711* (2013.01); *F05D 2250/74* (2013.01)

(58) Field of Classification Search
CPC ..... F05D 2250/28; F05D 2250/74; F05D 2240/123; F05D 2240/124; F01D 9/00; F01D 9/02; F01D 9/04; F01D 9/041; F01D 9/047
See application file for complete search history.

(56) References Cited

U.S. PATENT DOCUMENTS

2013/0104550 A1 5/2013 Smith et al.
2013/0104566 A1 5/2013 Stein et al.
2013/0170997 A1* 7/2013 Bielek ..... F01D 5/141 416/223 A
2017/0002670 A1* 1/2017 Bhaumik ..... F01D 9/047

OTHER PUBLICATIONS

U.S. Appl. No. 14/936,253, filed Nov. 9, 2015, Soumyik Kumar Bhaumik.
U.S. Appl. No. 14/937,992, filed Nov. 11, 2015, Soumyik Kumar Bhaumik.
U.S. Appl. No. 14/789,507, filed Jul. 1, 2015, Soumyik Kumar Bhaumik.

* cited by examiner

*Primary Examiner* — Woody Lee, Jr.
*Assistant Examiner* — Elton Wong
(74) *Attorney, Agent, or Firm* — Fletcher Yoder P.C.

(57) ABSTRACT

A turbine nozzle disposed in a turbine includes a suction side having a bulge, and a pressure side. The suction side and the pressure side extend opposite one another between a leading edge and a trailing edge in an axial direction transverse to a longitudinal axis of the turbine nozzle, and extends a radial direction along the longitudinal axis. The bulge is disposed on the suction side protruding relative to the other portion of the suction side in a direction transverse to both the radial and axial directions. The turbine nozzle has a first periphery defined at a first cross-section at a first location along the height of the turbine nozzle by selected coordinate sets listed in Table 1.

20 Claims, 16 Drawing Sheets

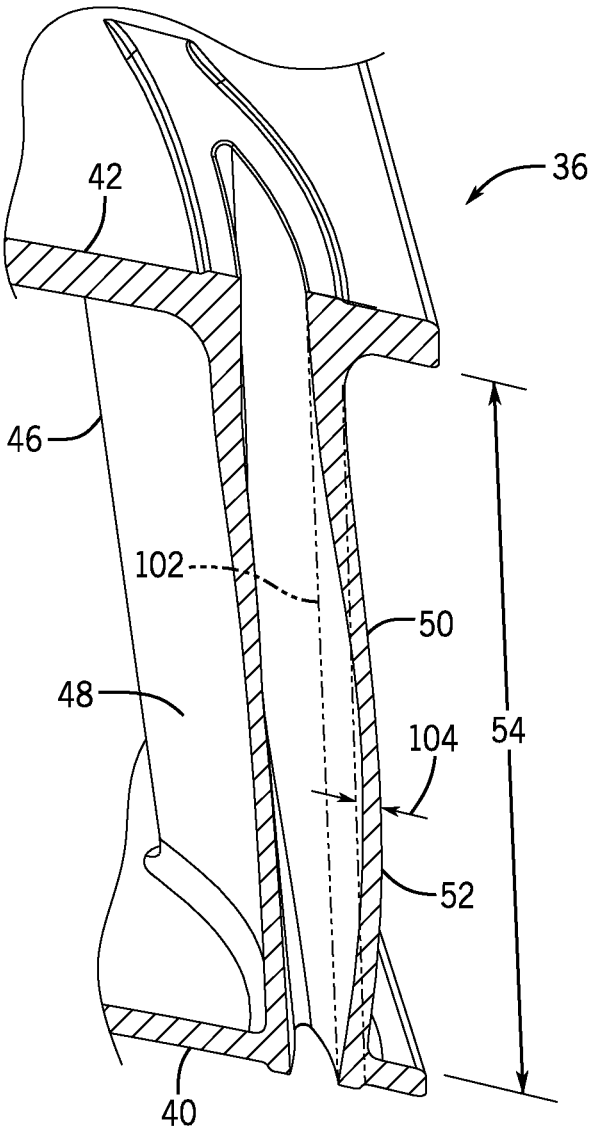
FIG. 9
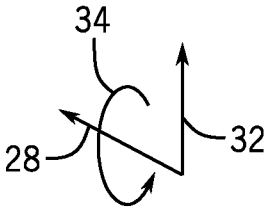

BULGED NOZZLE FOR CONTROL OF SECONDARY FLOW AND OPTIMAL DIFFUSER PERFORMANCE

BACKGROUND

The subject matter disclosed herein relates to turbomachines, and more particularly, the last nozzle stage in the turbine of a turbomachine.

A turbomachine, such as a gas turbine engine, may include a compressor, a combustor, and a turbine. Gasses are compressed in the compressor, combined with fuel, and then fed into to the combustor, where the gas/fuel mixture is combusted. The high temperature and high energy exhaust fluids are then fed to the turbine, where the energy of the fluids is converted to mechanical energy. In the last stage of a turbine, low root reaction may induce secondary flows transverse to the main flow direction. Secondary flows may negatively impact the efficiency of the last stage and lead to undesirable local hub swirl, which negatively affects the performance of the diffuser. As such, it would be beneficial to increase root reaction to control secondary flow and reduce local hub swirl.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the disclosed subject matter. Indeed, the subject matter may encompass a variety of forms that may be similar to or different from the embodiments set forth below.

In a first embodiment, a turbine nozzle configured to be disposed in a turbine includes a suction side, a pressure side, and a bulge disposed on the suction side. The suction side extends between a leading edge of the turbine nozzle and a trailing edge of the turbine nozzle in an axial direction and transverse to a longitudinal axis of the turbine nozzle, and extends a height of the turbine nozzle in a radial direction along the longitudinal axis. The pressure side is disposed opposite the suction side and extends between the leading edge of the turbine nozzle and the trailing edge of the turbine nozzle in the axial direction, and extends the height of the turbine nozzle in the radial direction. The bulge is disposed on the suction side of the turbine nozzle protruding relative to the other portion of the suction side in a direction transverse to both the radial and axial directions. The turbine nozzle has a first periphery defined at a first cross-section at a first location along the height of the turbine nozzle by selected coordinate sets listed in Table 1.

In a second embodiment, a system includes a turbine having a first annular wall, a second annular wall, and a last stage. The last stage includes a plurality of nozzles disposed annularly between the first and second annular walls about a rotational axis of the turbine. Each nozzle of the plurality of nozzles includes a height extending between the first and second annular walls, a leading edge, a trailing edge disposed downstream of the leading edge, a suction side extending between the leading edge and the trailing edge in an axial direction, and extending the height of the nozzle in a radial direction, a pressure side disposed opposite the suction side and extending between the leading edge of the nozzle and the trailing edge of the nozzle in the axial direction, and extending the height of the nozzle in the radial direction, and a bulge. The bulge is disposed on the suction side of the nozzle and protrudes in a direction transverse to a radial plane extending from the rotational axis. Each nozzle of the of the plurality of nozzles includes a first periphery defined at a first cross-section at a first location along the height of each nozzle of the plurality of nozzles by selected coordinate sets listed in Table 1.

In a third embodiment, a system includes a turbine having a first annular wall, a second annular wall, and a last stage. The last stage includes a plurality of nozzles disposed annularly between the first and second annular walls about a rotational axis of the turbine. Each nozzle of the plurality of nozzles includes a height between the first and second annular walls, a leading edge, a trailing edge disposed downstream of the leading edge, a suction side extending between the leading edge and the trailing edge in an axial direction, and extending the height of the nozzle in a radial direction, a pressure side disposed opposite the suction side and extending between the leading edge of the nozzle and the trailing edge of the nozzle in the axial direction, and extending the height of the nozzle in the radial direction, and a bulge. The bulge is disposed on the suction side of the nozzle and protrudes in a direction transverse to a radial plane extending from the rotational axis. Each nozzle of the plurality of nozzles includes first, second, third, fourth, and fifth peripheries. The first periphery is defined at a first cross section at a first location along the height of each nozzle of the plurality of nozzles by selected coordinate sets listed in Table 1. The second periphery is defined at a second cross section at a second location along the height of each nozzle of the plurality of nozzles different from the first location by selected coordinate sets listed in Table 2. The third periphery is defined at a third cross section at a third location along the height of each nozzle of the plurality of nozzles different from both the first and second locations by selected coordinate sets listed in Table 3. The fourth periphery is defined at a fourth cross section at a fourth location along the height of each nozzle of the plurality of nozzles different from the first, second, and third locations by selected coordinate sets listed in Table 4. The fifth periphery is defined at a fifth cross section at a fifth location along the height of each nozzle of the plurality of nozzles different from the first, second, third, and fourth locations by selected coordinate sets listed in Table 5. Additionally, each nozzle of the plurality of nozzles is angled relative to the radial plane toward the pressure side.

BRIEF DESCRIPTION OF THE DRAWINGS

These and other features, aspects, and advantages of the present subject matter will become better understood when the following detailed description is read with reference to the accompanying drawings in which like characters represent like parts throughout the drawings, wherein:

FIG. 9 is a section view of a nozzle with a suction side bulge in accordance with aspects of the present disclosure;

DETAILED DESCRIPTION

One or more specific embodiments of the present subject matter will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present subject matter, the articles "a," "an," "the," and "said" are intended to mean that there are one or more of the elements. The terms "comprising," "including," and "having" are intended to be inclusive and mean that there may be additional elements other than the listed elements.

Following combustion in a gas turbine engine, exhaust fluids exit the combustor and enter the turbine. Low root reaction may introduce strong secondary flows (i.e., flows transverse to the main flow direction) in the last stage of the turbine, reducing the efficiency of the last stage. Additionally, secondary flows in or around the downstream rotating airfoil hub may introduce undesirable swirl, which may appear as a swirl spike in the rotating airfoil exit flow profile, which negatively affects the performance of the diffuser. A nozzle design having a bulge on the suction side, a slight tilt toward the pressure side implemented in the last stage, and an opening of the throat near the hub region may be used to enable root reaction, thus reducing secondary flows and undesirable swirl.

Figure 1:
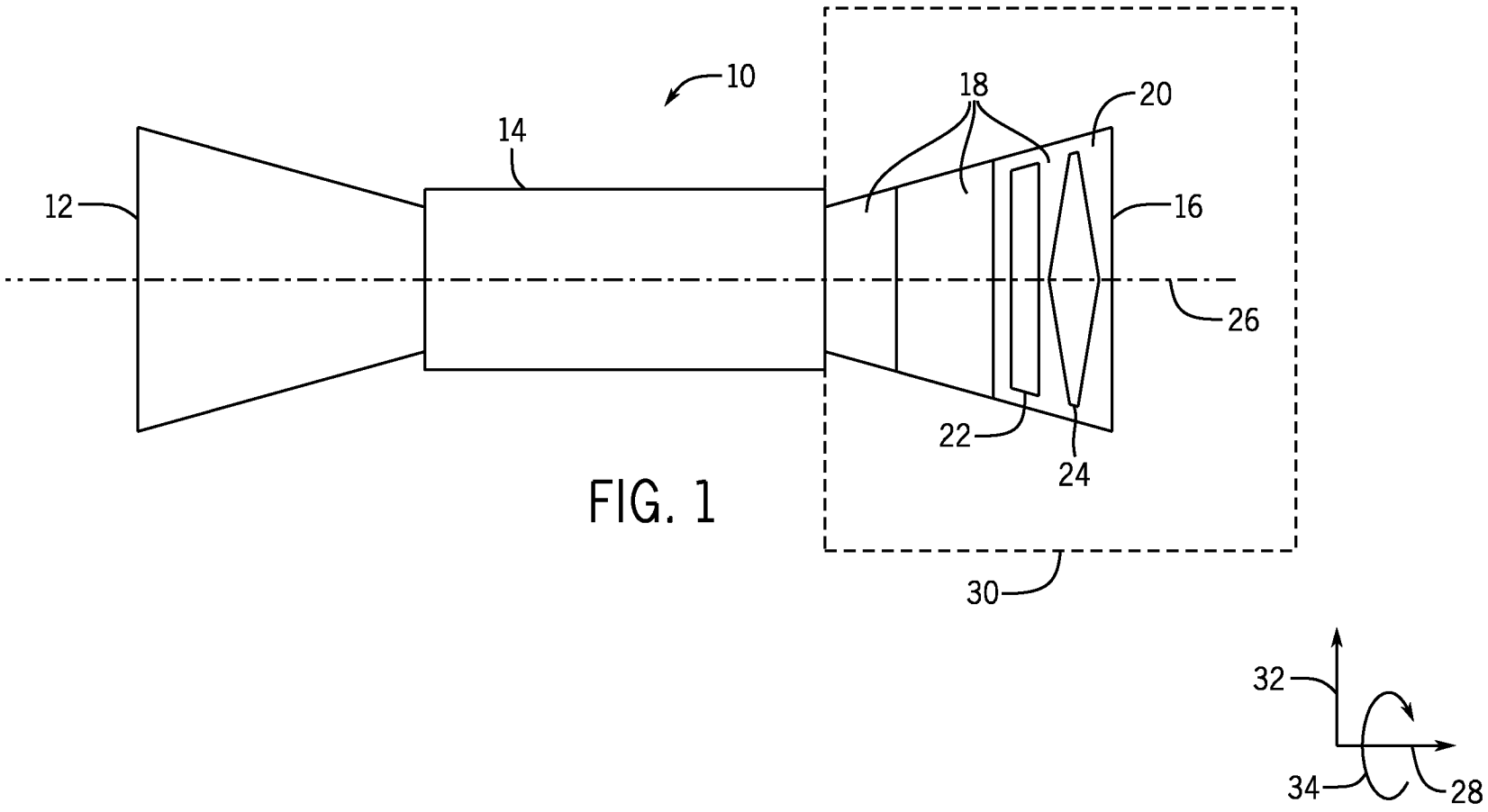
FIG. 1 is a diagram of one embodiment of a turbomachine in accordance with aspects of the present disclosure.

Turning now to the figures, FIG. 1 is a diagram of one embodiment of a turbomachine 10 (e.g., a gas turbine engine). The turbomachine 10 shown in FIG. 1 includes a compressor 12, a combustor 14, and a turbine 16. Air, or some other gas, is compressed in the compressor 12, mixed with fuel, fed into the combustor 14, and then combusted. The exhaust fluids are fed to the turbine 16 where the energy from the exhaust fluids is converted to mechanical energy. The turbine includes a plurality of stages 18, including a last stage 20. Each stage 18, may include a rotor, coupled to a rotating shaft, with an annular array of axially aligned blades, buckets, or airfoils, which rotates about a rotational axis 26, and a stator with an annular array of nozzles. Accordingly, the last stage 20 may include a last nozzle stage 22 and a last airfoil stage 24. For clarity, FIG. 1 includes a coordinate system including an axial direction 28, a radial direction 32, and a circumferential direction 34. Additionally, a radial plane 30 is shown. The radial plane 30 extends in the axial direction 28 (along the rotational axis 26) in one direction, and then extends outward in the radial direction.

Figure 2:
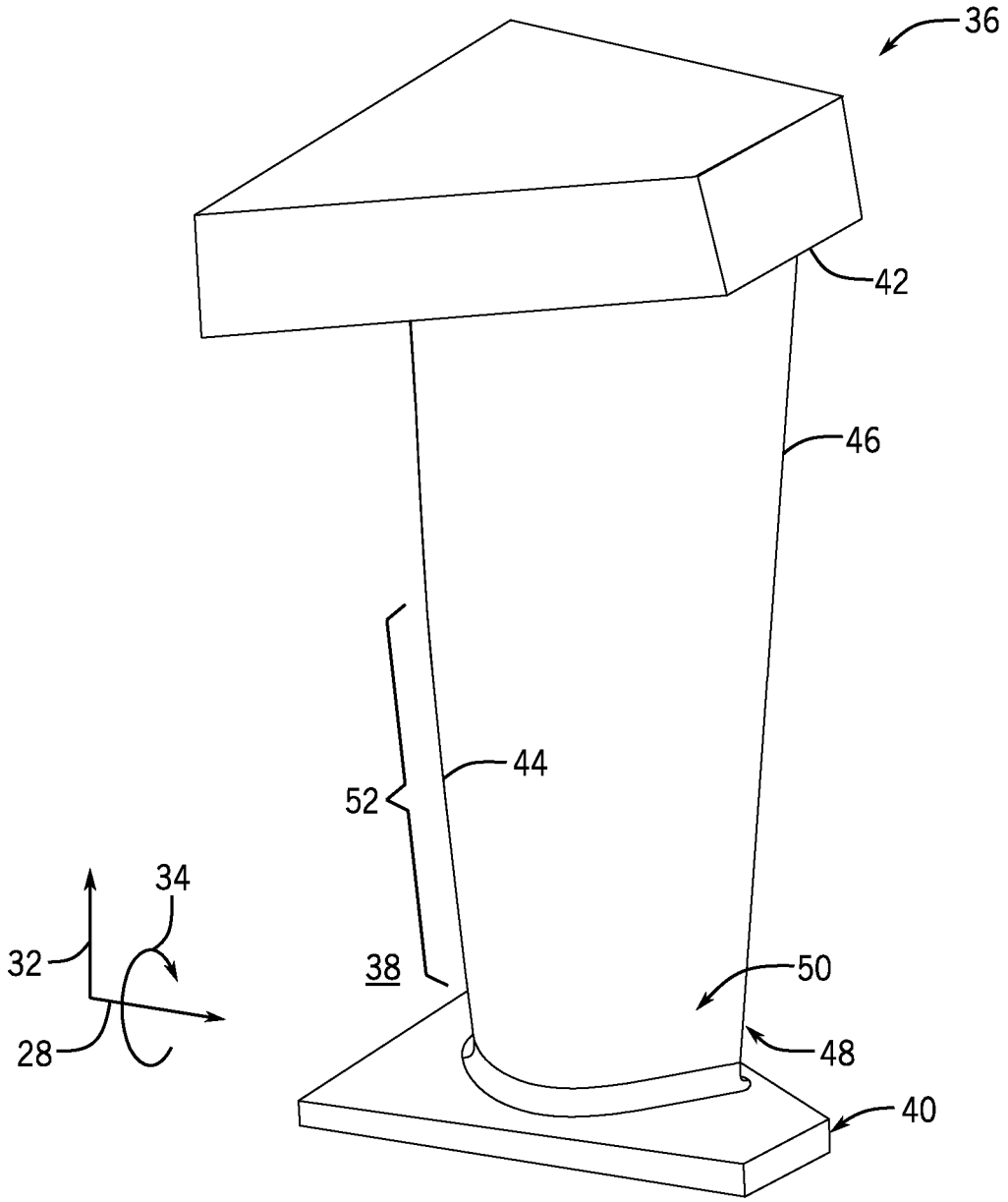
FIG. 2 is a perspective front view of one embodiment of a nozzle in accordance with aspects of the present disclosure.

FIG. 2 is a front perspective view (i.e., looking generally downstream) of an embodiment of a nozzle 36. The nozzles 36 in a last stage 20 are configured to extend in a radial direction 32 between a first annular wall 40 and a second annular wall 42. Each nozzle 36 may have an airfoil type shape and be configured to aerodynamically interact with the exhaust fluids from the combustor 14 as the exhaust fluids flow generally downstream through the turbine 16 in the axial direction 28. Each nozzle 36 has a leading edge 44, a trailing edge 46 disposed downstream, in the axial direction 28, of the leading edge 44, a pressure side 48, and a suction side 50. The pressure side 48 extends in the axial direction 28 between the leading edge 44 and the trailing edge 46, and in the radial direction 32 between the first annular wall 40 and the second annular wall 42. The suction side 50 extends in the axial direction 28 between the leading edge 44 and the trailing edge 46, and in the radial direction 32 between the first annular wall 40 and the second annular wall 42, opposite the pressure side 48. The nozzles 36 in the last stage 20 are configured such that the pressure side 48 of one nozzle 36 faces the suction side 50 of an adjacent nozzle 36. As the exhaust fluids flow toward and through the passage 38 between nozzles 36, the exhaust fluids aerodynamically interact with the nozzles 36 such that the exhaust fluids flow with an angular momentum relative to the axial direction 28. Low root reaction may introduce strong secondary flows and undesirable swirl in the last blade stage 20 of the turbine, reducing the efficiency of the last blade stage 20 and the performance of the diffuser. A last nozzle stage 24 populated with nozzles 36 having a bulge 52 protruding from the lower part of the suction side, which opens the throat near the hub region, (and in some embodiments, a slight tilt toward the pressure side 48) may encourage root reaction, thus reducing secondary flows and undesirable swirl.

Figure 4:
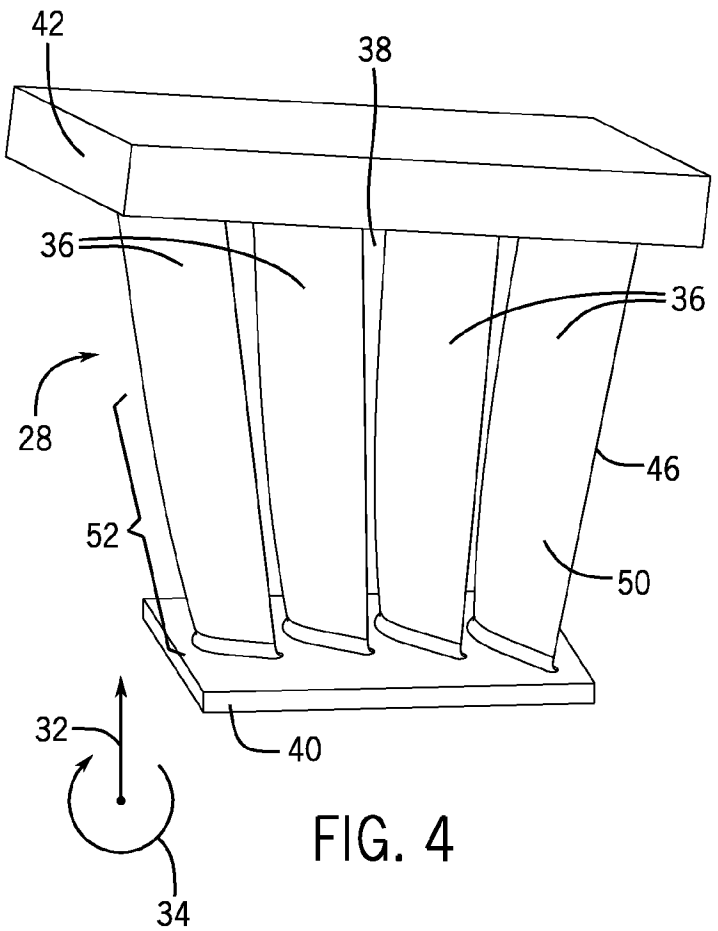
FIG. 4 is a back view of one embodiment of a partial array of nozzles designed with a suction bulge in a stage of a turbine in accordance with aspects of the present disclosure.
Figure 3:
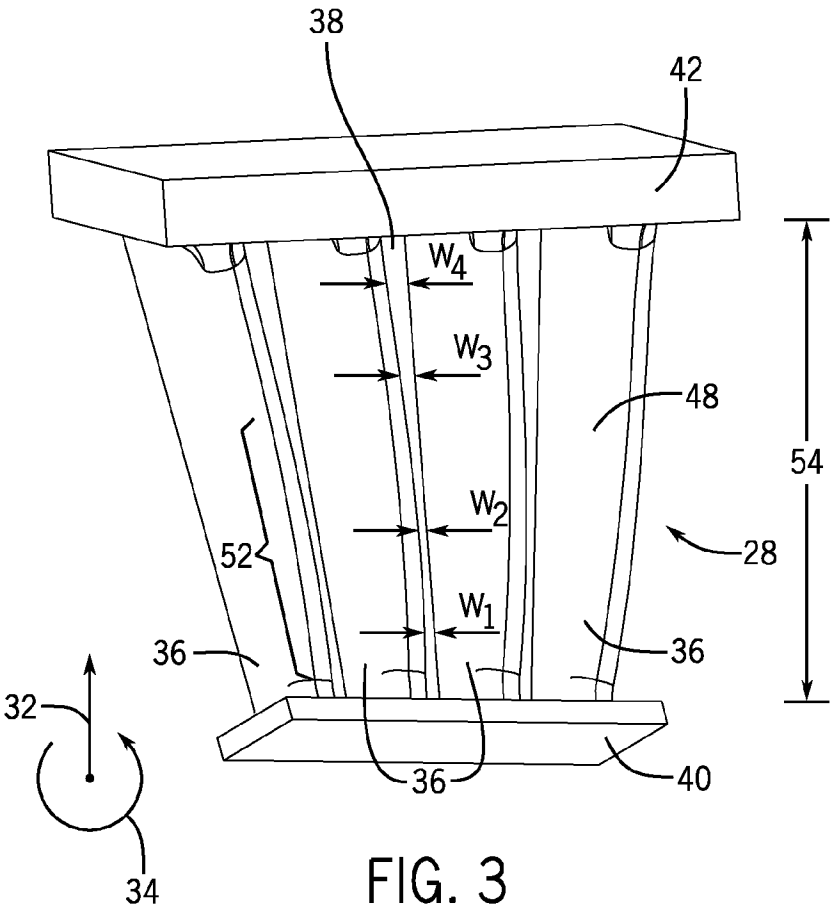
FIG. 3 is a front view of one embodiment of a partial array of nozzles designed with a suction bulge in a stage of a turbine in accordance with aspects of the present disclosure.

FIGS. 3 and 4 show a front perspective view (i.e., facing generally downstream in the axial direction 28) and a back perspective view (i.e., facing generally upstream against the axial direction 28), respectively, of a partial array of nozzles 36, extending in a radial direction 32 between first and second annular walls 40, 42, designed with a suction side bulge 52 in a last nozzle stage 24 of a turbine 16. Note that the width of the passages 38 between the nozzles 36 begins near the bottom of the nozzles 36 having a width $W_1$. The passage 38 width $W_2$ is smallest when the bulge 52 is largest, around 20-40% up the height 54 of the nozzle 36 and the radial direction 32, and then the passage 38 width $W_3$, $W_4$ gets larger toward the top of the nozzles 36 as the bulge 52 subsides.

Figure 5:
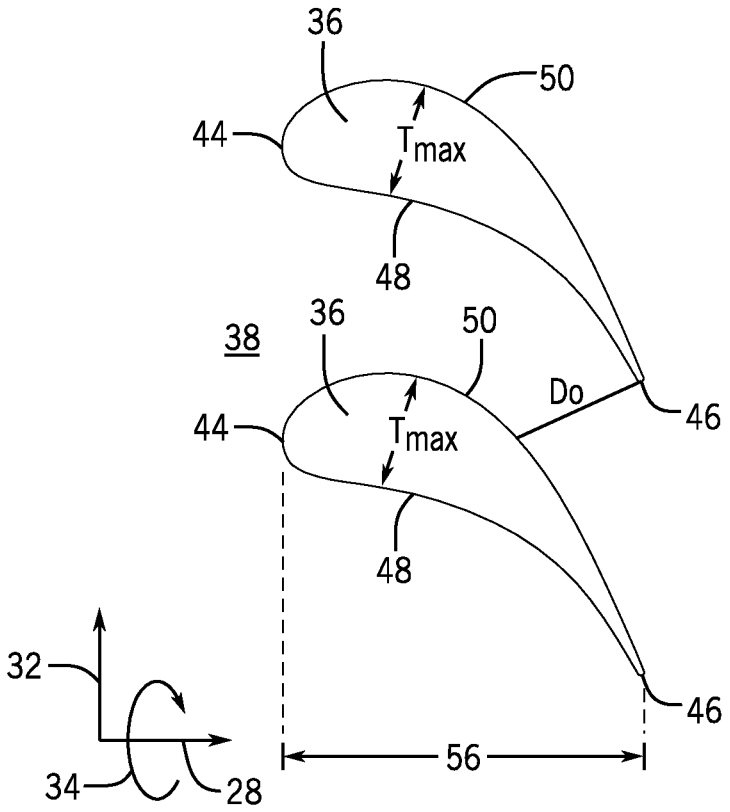
FIG. 5 is a top section view of two adjacent nozzles in accordance with aspects of the present disclosure.

FIG. 5 is a top view of two adjacent nozzles 36. Note how the suction side 50 of the bottom nozzle 36 faces the pressure side 48 of the top nozzle. The axial chord 56 is the dimension of the nozzle 36 in the axial direction. The passage 38 between two adjacent nozzles 36 of a stage 18 defines a throat $D_o$, measured at the narrowest region of the passage 38 between adjacent nozzles 36. Fluid flows through the passage 38 in the axial direction 28. This distribution of $D_o$ along the height of the nozzle 36 will be discussed in more detail in regard to FIG. 6. The maximum thickness of each nozzle 36 at a given height is shown as $T_{max}$. The $T_{max}$ distribution across the height of the nozzle 36 will be discussed in more detail in regard to FIGS. 7 and 8.

Figure 6:
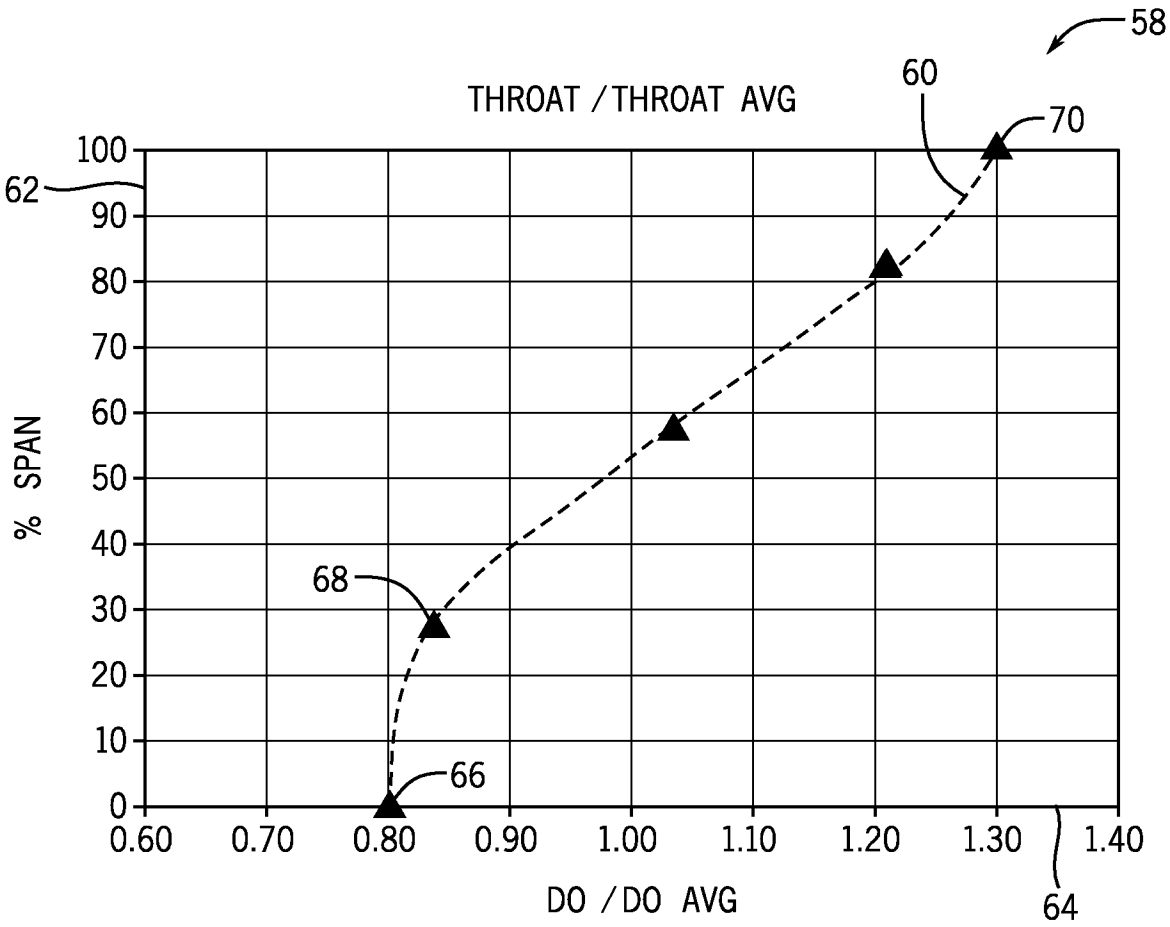
FIG. 6 is a graphical representation of a non-dimensional throat distribution defined by adjacent nozzles in a stage of a turbine in accordance with aspects of the present disclosure.

FIG. 6 is a plot 58 of throat $D_o$ distribution defined by adjacent nozzles 36 in the last stage 20 is shown as curve 60. The vertical axis 62, x, represents the percent span between the first annular wall 40 and the second annular wall in the radial direction 32, or the percent span along the height 54 of the nozzle 36 in the radial direction 32. That is, 0% span represents the first annular wall 40 and 100% span represents the second annular wall 42, and any point between 0% and 100% corresponds to a percent distance between the annular walls 40, 42, in the radial direction 32 along the height of the nozzle. The horizontal axis 64, y, represents $D_o$, the shortest distance between two adjacent nozzles 36 at a given percent span, divided by the $D_{o,AVG}$, the average $D_o$ across the entire height of the nozzle 36. Dividing $D_o$ by the $D_{o,AVG}$ makes the plot 58 non-dimensional, so the curve 60 remains the same as the nozzle stage 22 is scaled up or down for different applications. One could make a similar plot for a single size of turbine in which the horizontal axis is just $D_o$.

As can be seen in FIG. 6, as one moves in the radial direction 32 from the first annular wall 40, or point 66, the bulge 52 maintains $D_o$ at about 80% of the average $D_o$. At point 68, about the middle of the bulge 52, (e.g., approximately 30% up the height 54 of the nozzle), the bulge 52 begins to recede and $D_o$ grows to approximately 1.3 times the average $D_o$ at the second annular wall 42, or point 70. This throat $D_o$ distribution encourages root reaction in the last blade stage 20, which improves the efficiency of the last blade stage and performance of the diffuser, which may result in a substantial increase in power output for the turbine. In some embodiments, the may increase power output by more than 1.7 MW.

Figure 7:
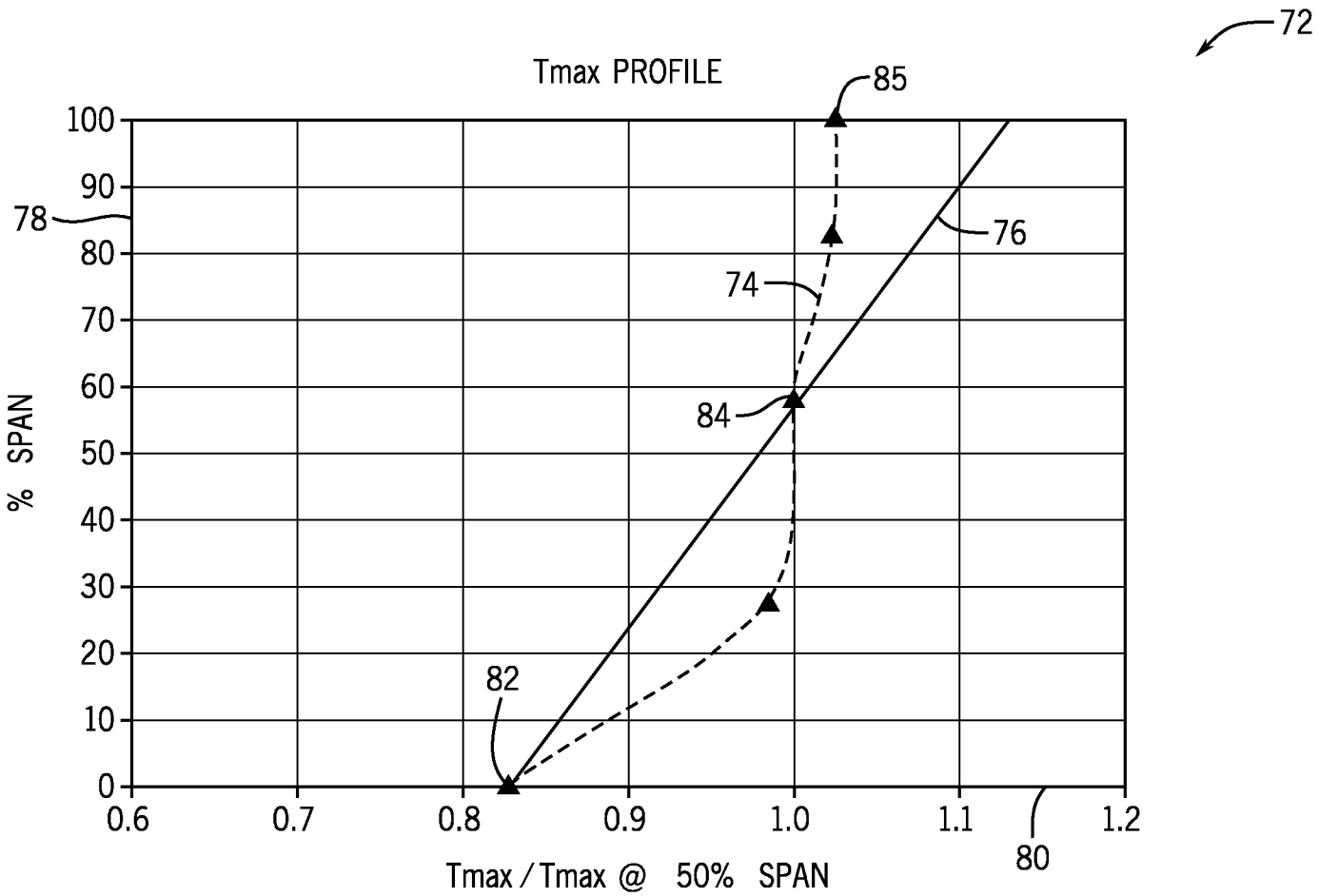
FIG. 7 is a graphical representation of a non-dimensional distribution of the maximum nozzle thickness divided by the maximum nozzle thickness at 50% span in accordance with aspects of the present disclosure.

FIG. 7 is a plot 72 of the distribution of $T_{max}/T_{max}$ at 50% span as curve 74, as compared to a nozzle of conventional design 76. The vertical axis 78, x, represents the percent span between the first annular wall 40 and the second annular wall in the radial direction 32, or the percent span along the height 54 of the nozzle 36 in the radial direction 32. The horizontal axis 80, y, represents $T_{max}$, the maximum thickness of the nozzle 36 at a given percent span, divided by the $T_{max}$ at 50% span. Dividing $T_{max}$ by $T_{max}$ at 50% span makes the plot 72 non-dimensional, so the curve 74 remains the same as the nozzle stage 22 is scaled up or down for different applications. One could make a similar plot for a single size of turbine in which the horizontal axis is just $T_{max}$.

As can be seen in FIG. 7, as one moves in the radial direction 32 from the first annular wall 40, or point 82, $T_{max}$ starts out at approximately 83% of $T_{max}$ at 50% span and then quickly approaches $T_{max}$ at 50% span. From 35% span to about 60% span, $T_{max}$ is substantially the same as $T_{max}$ at 50% span. At point 84, or approximately 60% span, $T_{max}$ diverges from $T_{max}$ at 50% span, and remains larger than $T_{max}$ at 50% span until the nozzle 22 reaches the second annular wall 42, or point 86.

Figure 8:
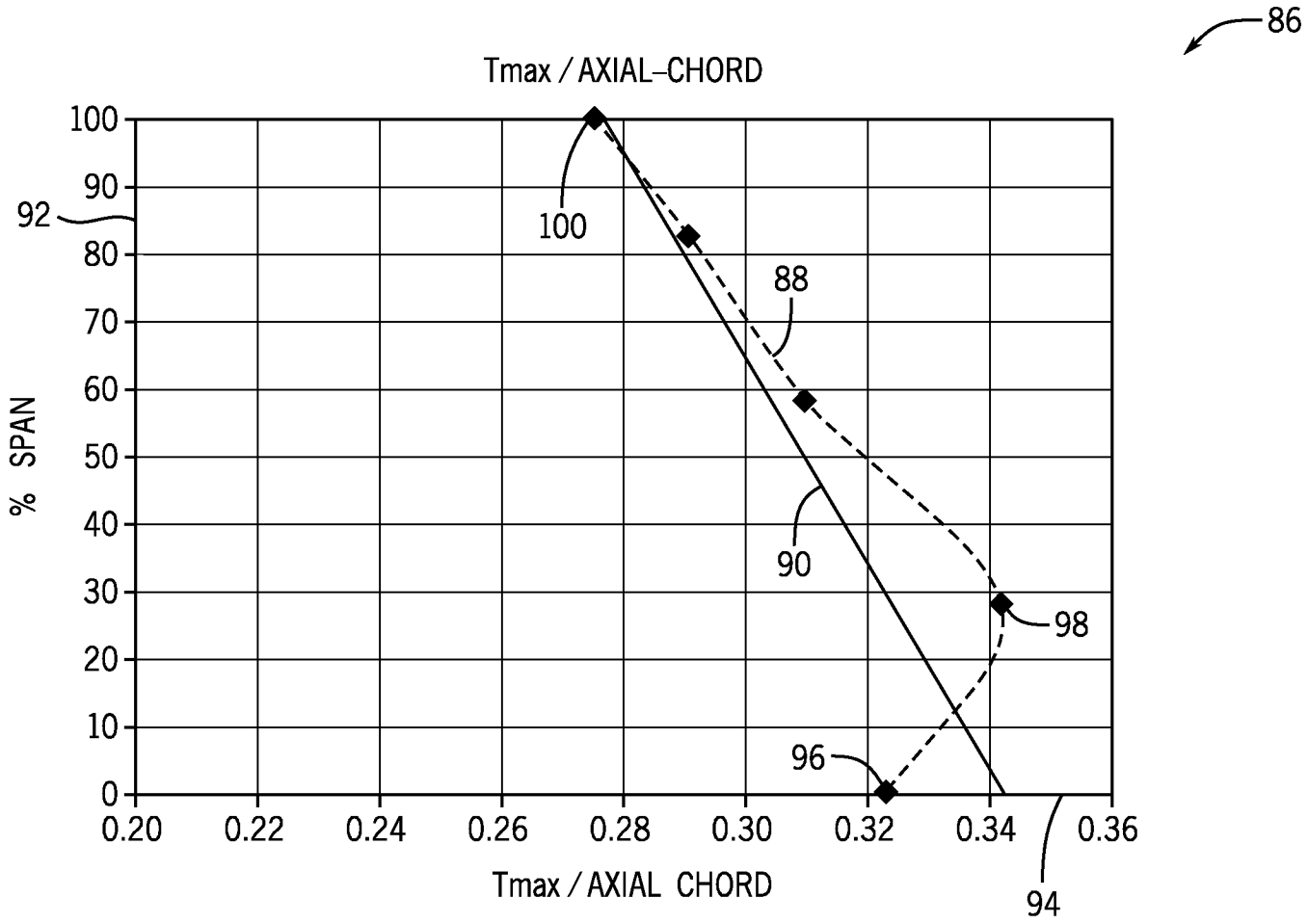
FIG. 8 is a graphical representation of a non-dimensional distribution of the maximum nozzle thickness divided by the axial chord in accordance with aspects of the present disclosure.

FIG. 8 is a plot 86 of the distribution of $T_{max}$/axial chord as curve 88, as compared to a nozzle of conventional design 90. The vertical axis 92, x, represents the percent span between the first annular wall 40 and the second annular wall 42 in the radial direction 32, or the percent span along the height 54 of the nozzle 36 in the radial direction 32. The horizontal axis 94, y, represents $T_{max}$, the maximum thickness of the nozzle 36 at a given percent span, divided by the axial chord 56, the dimension of the nozzle 36 in the axial direction 28. Dividing $T_{max}$ by the axial chord 56 makes the plot 86 non-dimensional, so the curve 88 remains the same as the nozzle stage 22 is scaled up or down for different applications.

As can be seen in FIG. 8, as one moves in the radial direction 32 from the first annular wall 40, or point 96, $T_{max}$ starts out smaller than the conventional design, but grows larger than the conventional design as the bulge reaches its maximum divergence from the conventional design at point 98. From point 98 to the second annular wall 42 (point 100), the $T_{max}$ approaches the $T_{max}$ of the conventional design. This maximum thickness $T_{max}$ distribution encourages root reaction in the last blade stage 20, which improves the efficiency of the last blade stage and performance of the diffuser, which may result in a substantial increase in power output for the turbine. In some embodiments, the may increase power output by more than 1.7 MW.

FIG. 9 is a side section view of a nozzle 36 with a suction side 50 bulge 52. The dotted lines 102 in FIG. 9 represent the suction side wall 102 of a radially stacked nozzle (i.e., a similar nozzle design without a bulge 52). The bulge 52 protrudes from the suction side 50 in a direction transverse to the radial plane 30 extending from the rotational axis 26 out in the radial direction 32 in one direction, and in the axial direction 28 in a second direction. Distance 104 represents the distance the bulge protrudes from the hypothetical suction side 102 of a radially stacked nozzle without a bulge 52 at the point along the height 54 of the nozzle 36 at which the bulge 52 is at its maximum protrusion. As may be seen in FIG. 9, the bulge 52 may begin to protrude at a position between approximately 0-20% of the height of the nozzle 36 (i.e., 0-20% of the span from the first annular wall 40 to the second annular wall 42). That is, the profile of a nozzle 36 with a bulge 52 may begin to diverge from the hypothetical suction side wall 102 of a radially stacked nozzle at any point from the bottom of the nozzle 36 (i.e., where the nozzle 36 meets the first annular wall 40) to approximately 20% of the height 54 of the nozzle 36. For example, the bulge 52 may begin to protrude at approximately 0%, 2%, 5%, 15%, or 20% of the height 54 of the nozzle 36, or anywhere in between. In other embodiments, the bulge may begin to protrude between approximately 1% and 15% of the height 54 of the nozzle 36, or between approximately 5% and 10% of the height 54 of the nozzle 36. The bulge 52 may have a maximum protrusion 104 (i.e., the maximum deviation from the suction side wall 102 of a radially stacked nozzle) between approximately 0.5% and 10% of the height 54 of the nozzle 36. Alternatively, the maximum bulge protrusion 104 may be between approximately 0.5% and 5.0%, or between 1.0% and 4.0% of the height 54 of the nozzle 36. The bulge 52 may reach its maximum protrusion 104 between approximately 20% and 40% of the height 54 of the nozzle 36 (i.e., between approximately 20% and 40% of the span from the first annular wall 40 to the second annular wall 42). For example, the maximum bulge protrusion may occur at approximately 20%, 22%, 24%, 26%, 28%, 30%, 32%, 34%, 38%, or 40% of the height 54 of the nozzle 36, or anywhere in between. In some embodiments, the bulge 52 may reach its maximum protrusion 104 between approximately 20% and 40%, between 22% and 38%, between 25% and 35%, or between 28% and 32% of the height 54 of the nozzle 36. Upon reaching the maximum bulge protrusion 104, the profile of the nozzle 36 with the suction side bulge 52 begins to converge with the suction side wall 102 of the radially stacked nozzle. The bulge 52 may end (i.e., the profile of the nozzle 36 with the suction side bulge 52 converges with the suction side wall 102 of the radially stacked nozzle) at a point between approximately 50% and 60% of the height 54 of the nozzle 36 (i.e., between approximately 50% and 60% of the span from the first annular wall 40 to the second annular wall 42). In other embodiments, the bulge 52 may end at a point between approximately 52% and 58%, 53% and 57%, or 54% and 56% of the height 54 of the nozzle 36. That is, the bulge 52 may end at a point approximately 50%, 52%, 54%, 56%, 58%, or 60% of the height 54 of the nozzle 36, or anywhere in between. In some embodiments, the bulge 52 may extend along the entire length of the suction side 50 in the axial direction 28, from the leading edge 44 to the trailing edge 46. In other embodiments, the bulge 52 may extend only along a portion of the suction side 50, between the leading edge 44 and the trailing edge 46. A last stage stator 22 populated with nozzles 36 having bulges 52 on the suction side 50 encourages root reaction, which helps to reduce secondary flows and undesirable swirling. Implementation of the disclosed techniques may increase the performance of both the last stage and the diffuser, resulting in a substantial benefit in the output of the turbomachine. In some embodiments, the disclosed techniques may improve the performance of the last blade stage by approximately 200 KW or more, and may improve diffuser performance by approximately 1500 KW or more, for a total benefit of approximately 1700 KW or more. It should be understood, however, that benefits resulting from implementation of the disclosed techniques may vary from turbomachine to turbomachine.

Figure 10:
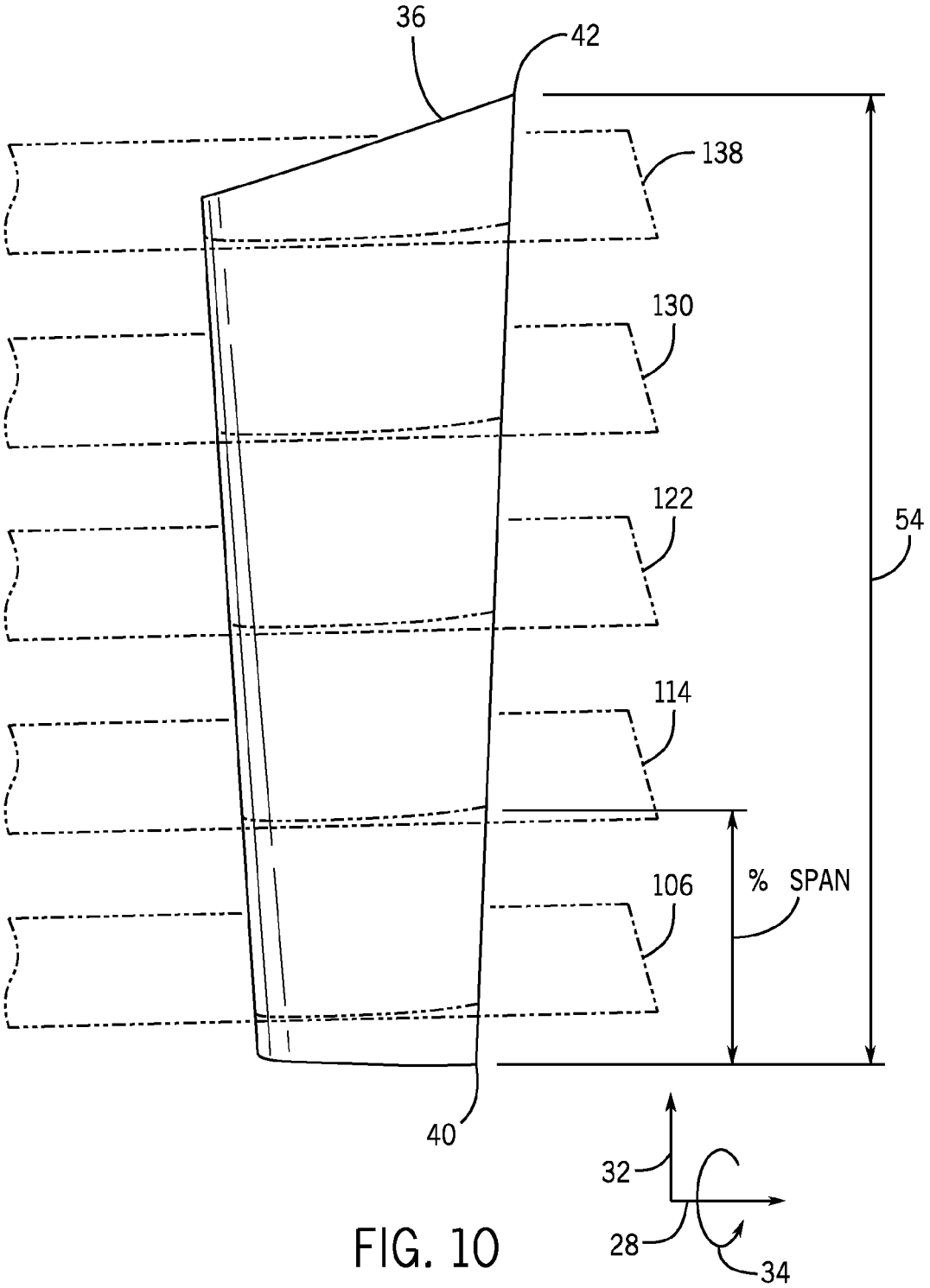
FIG. 10 shows five planes at five span locations intersecting the nozzle with a suction side bulge in accordance with aspects of the present disclosure.

Another way to articulate the shape of the nozzle 36 is with the Y, Z coordinates of a number of different points along the periphery of the nozzle at various cross sections. FIG. 10 shows five planes 106, 114, 122, 130, 138 at five span locations across the height of the nozzle 36. Plane 106 is at 6% span, plane 114 is at 26% span, plane 122 is at 46% span, plane 130 is at 66% span, and plane 138 is at 86% span. The shape of the nozzle may be defined by the cross-sectional shape of the nozzle at these five planes 106, 114, 122, 130, 138. Cross-sectional shapes of the nozzle at these planes and the Y, Z coordinates of the outer periphery of the nozzle are shown in FIGS. 11-15 and Tables 1-5. It should be understood, however, that this is merely one embodiment and that the dimensions may change as the nozzle 36 is scaled up or down for various turbomachines 10 (e.g., from a 50 Hz machine to a 60 Hz machine, or a gearbox machine, etc.)

FIGS. 11-15 provide cross-sectional views of the shape of the periphery of the nozzle 36 at the five planes 106, 114, 122, 130, 138 at various span locations across the height 54 of the nozzle 36. Tables 1-5, which correspond to FIGS. 11-15, each give the Y, Z coordinates of fifty points around the periphery of the nozzle 36 for each of the five cross-sections.

Figure 11:
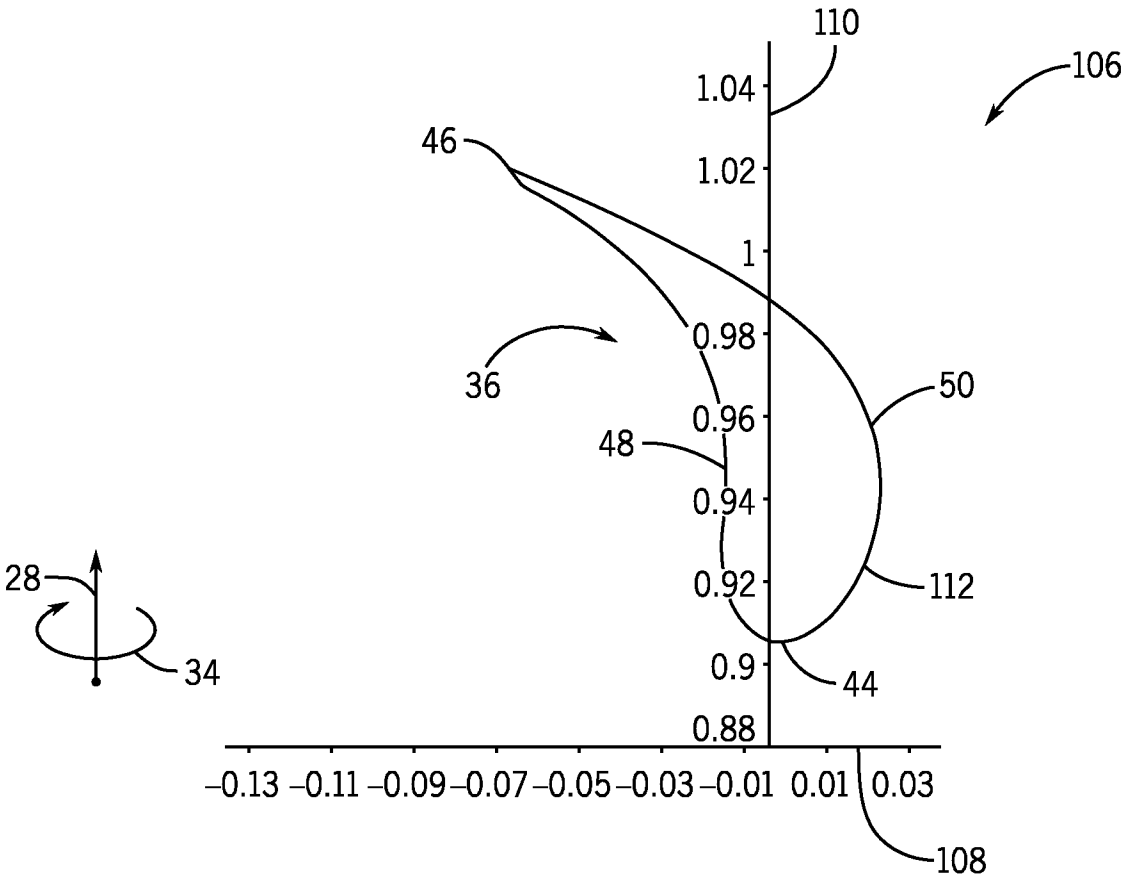
FIG. 11 is a cross-sectional view of a nozzle with a suction side bulge at a first height in accordance with aspects of the present disclosure.

FIG. 11 is a plot 106 illustrating a cross-sectional view of a periphery or perimeter (indicated by reference numeral 112) of the nozzle 36 at a first cross section at approximately 6% span. The horizontal axis of the plot 106 is the y-axis 108 in meters. The vertical axis of the plot 106 is the z-axis 110 in meters and corresponds to the rotational axis 26 shown in FIG. 1. The XZ plane corresponds to the radial plane 30 as shown in FIG. 1. The periphery of the nozzle 36 is represented by a plane located at approximately 6% span. Table 1 provides the Y, Z coordinates for 50 points disposed along the periphery or perimeter 112 of the nozzle 36 at a plane located at approximately 6% span.

TABLE 1

| Span | Y | Z |
|---|---|---|
| 6% | −0.0646 | 1.0220 |
| 6% | −0.0585 | 1.0193 |
| 6% | −0.0524 | 1.0166 |
| 6% | −0.0463 | 1.0138 |
| 6% | −0.0403 | 1.0110 |
| 6% | −0.0343 | 1.0081 |
| 6% | −0.0283 | 1.0052 |
| 6% | −0.0223 | 1.0022 |
| 6% | −0.0164 | 0.9990 |
| 6% | −0.0106 | 0.9958 |
| 6% | −0.0050 | 0.9923 |
| 6% | 0.0006 | 0.9886 |
| 6% | 0.0058 | 0.9845 |
| 6% | 0.0108 | 0.9800 |
| 6% | 0.0153 | 0.9752 |
| 6% | 0.0193 | 0.9698 |
| 6% | 0.0226 | 0.9640 |
| 6% | 0.0251 | 0.9579 |
| 6% | 0.0267 | 0.9514 |
| 6% | 0.0273 | 0.9448 |
| 6% | 0.0271 | 0.9381 |
| 6% | 0.0259 | 0.9316 |
| 6% | 0.0238 | 0.9252 |
| 6% | 0.0210 | 0.9192 |
| 6% | 0.0172 | 0.9137 |
| 6% | 0.0126 | 0.9089 |
| 6% | 0.0069 | 0.9055 |
| 6% | 0.0004 | 0.9049 |
| 6% | −0.0053 | 0.9082 |
| 6% | −0.0094 | 0.9135 |
| 6% | −0.0115 | 0.9198 |
| 6% | −0.0121 | 0.9264 |
| 6% | −0.0118 | 0.9330 |
| 6% | −0.0114 | 0.9397 |
| 6% | −0.0111 | 0.9464 |
| 6% | −0.0113 | 0.9530 |
| 6% | −0.0120 | 0.9596 |
| 6% | −0.0135 | 0.9661 |
| 6% | −0.0156 | 0.9724 |
| 6% | −0.0184 | 0.9785 |
| 6% | −0.0219 | 0.9842 |
| 6% | −0.0258 | 0.9896 |
| 6% | −0.0302 | 0.9946 |
| 6% | −0.0349 | 0.9993 |
| 6% | −0.0400 | 1.0036 |
| 6% | −0.0453 | 1.0076 |
| 6% | −0.0508 | 1.0113 |
| 6% | −0.0565 | 1.0149 |
| 6% | −0.0622 | 1.0184 |
| 6% | −0.0646 | 1.0220 |

Figure 12:
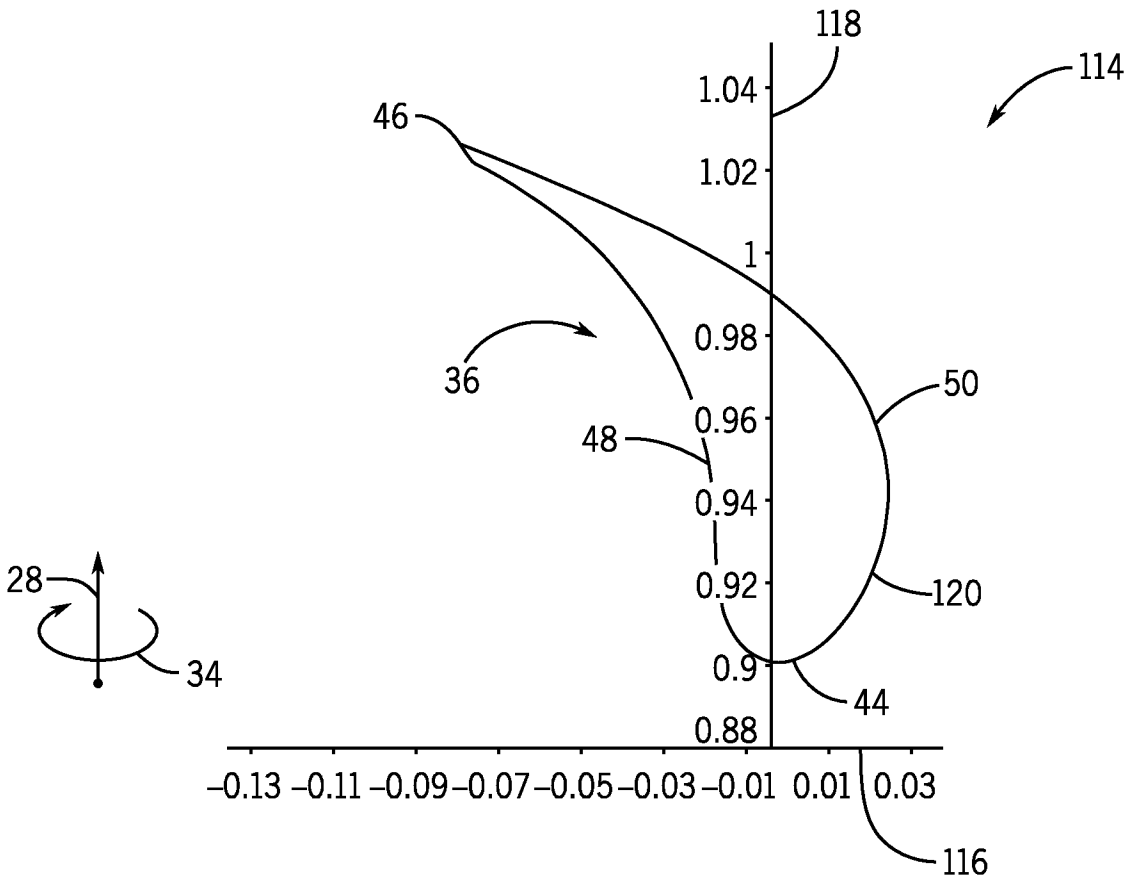
FIG. 12 is a plot of the periphery of a cross section of a nozzle with a suction side bulge at a second height in accordance with aspects of the present disclosure.

FIG. 12 is a plot 114 illustrating a cross-sectional view of the periphery or perimeter (indicated by reference numeral 120) of the nozzle 36 at a second cross section at approximately 26% span. The horizontal axis of the plot 114 is the y-axis 116 in meters. The vertical axis of the plot 114 is the z-axis 118 in meters and corresponds to the rotational axis 26 shown in FIG. 1. The XZ plane corresponds to the radial plane 30 as shown in FIG. 1. The periphery of the nozzle 36 is represented by a plane located at approximately 26% span. Table 2 provides the Y, Z coordinates for 50 points disposed along the periphery or perimeter 120 of the nozzle 36 at a plane located at approximately 26% span.

TABLE 2

| Span | Y | Z |
|---|---|---|
| 26% | −0.0766 | 1.0285 |
| 26% | −0.0698 | 1.0257 |
| 26% | −0.0630 | 1.0229 |
| 26% | −0.0562 | 1.0200 |
| 26% | −0.0494 | 1.0171 |
| 26% | −0.0426 | 1.0142 |
| 26% | −0.0359 | 1.0111 |
| 26% | −0.0292 | 1.0080 |
| 26% | −0.0226 | 1.0047 |
| 26% | −0.0160 | 1.0012 |
| 26% | −0.0096 | 0.9975 |
| 26% | −0.0034 | 0.9935 |
| 26% | 0.0026 | 0.9892 |
| 26% | 0.0083 | 0.9845 |
| 26% | 0.0136 | 0.9793 |
| 26% | 0.0183 | 0.9737 |
| 26% | 0.0224 | 0.9675 |
| 26% | 0.0256 | 0.9609 |
| 26% | 0.0279 | 0.9539 |
| 26% | 0.0291 | 0.9466 |
| 26% | 0.0292 | 0.9392 |
| 26% | 0.0282 | 0.9319 |
| 26% | 0.0263 | 0.9248 |
| 26% | 0.0233 | 0.9180 |
| 26% | 0.0194 | 0.9117 |
| 26% | 0.0144 | 0.9063 |
| 26% | 0.0084 | 0.9020 |
| 26% | 0.0013 | 0.9002 |
| 26% | −0.0055 | 0.9028 |
| 26% | −0.0100 | 0.9086 |
| 26% | −0.0123 | 0.9156 |
| 26% | −0.0133 | 0.9229 |
| 26% | −0.0137 | 0.9303 |
| 26% | −0.0141 | 0.9377 |
| 26% | −0.0148 | 0.9450 |
| 26% | −0.0160 | 0.9523 |
| 26% | −0.0177 | 0.9595 |
| 26% | −0.0200 | 0.9665 |
| 26% | −0.0228 | 0.9733 |
| 26% | −0.0262 | 0.9799 |
| 26% | −0.0300 | 0.9862 |
| 26% | −0.0343 | 0.9923 |
| 26% | −0.0390 | 0.9980 |
| 26% | −0.0441 | 1.0033 |
| 26% | −0.0496 | 1.0083 |
| 26% | −0.0554 | 1.0128 |
| 26% | −0.0615 | 1.0169 |
| 26% | −0.0678 | 1.0208 |
| 26% | −0.0742 | 1.0245 |
| 26% | −0.0766 | 1.0285 |

Figure 13:
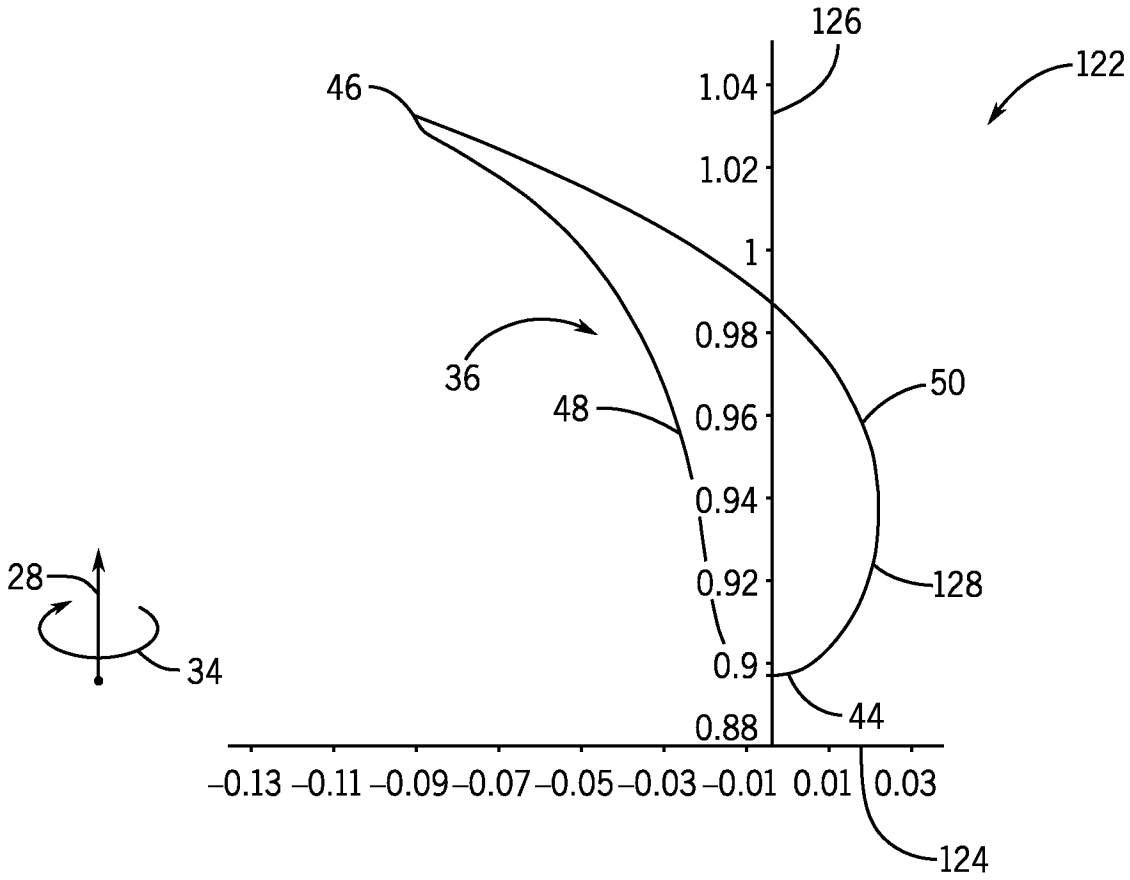
FIG. 13 is plot of the periphery of a cross section of a nozzle with a suction side bulge at a third height in accordance with aspects of the present disclosure.

FIG. 13 is a plot 122 illustrating a cross-sectional view of the periphery or perimeter (indicated by reference numeral 128) of the nozzle 36 at a third cross section at approximately 46% span. The horizontal axis of the plot 122 is the y-axis 124 in meters. The vertical axis of the plot 122 is the z-axis 126 in meters and corresponds to the rotational axis 26 shown in FIG. 1. The XZ plane corresponds to the radial plane 30 as shown in FIG. 1. The periphery of the nozzle 36 is represented by a plane at approximately 46% span. Table 3 provides the Y, Z coordinates of 50 points disposed along the periphery or perimeter 128 of the nozzle 36 at a plane located at approximately 46% span.

TABLE 3

| Span | Y | Z |
|---|---|---|
| 46% | −0.0887 | 1.0350 |
| 46% | −0.0813 | 1.0319 |
| 46% | −0.0740 | 1.0288 |
| 46% | −0.0667 | 1.0256 |
| 46% | −0.0594 | 1.0224 |
| 46% | −0.0521 | 1.0191 |
| 46% | −0.0449 | 1.0156 |
| 46% | −0.0378 | 1.0120 |
| 46% | −0.0307 | 1.0083 |
| 46% | −0.0238 | 1.0044 |
| 46% | −0.0170 | 1.0002 |
| 46% | −0.0104 | 0.9958 |
| 46% | −0.0040 | 0.9910 |
| 46% | 0.0021 | 0.9858 |
| 46% | 0.0077 | 0.9802 |
| 46% | 0.0129 | 0.9741 |
| 46% | 0.0174 | 0.9675 |
| 46% | 0.0211 | 0.9604 |
| 46% | 0.0239 | 0.9530 |
| 46% | 0.0257 | 0.9452 |
| 46% | 0.0263 | 0.9372 |
| 46% | 0.0258 | 0.9293 |
| 46% | 0.0242 | 0.9215 |
| 46% | 0.0215 | 0.9140 |
| 46% | 0.0176 | 0.9070 |
| 46% | 0.0123 | 0.9010 |
| 46% | 0.0056 | 0.8969 |
| 46% | −0.0022 | 0.8960 |
| 46% | −0.0093 | 0.8994 |
| 46% | −0.0132 | 0.9063 |
| 46% | −0.0151 | 0.9141 |
| 46% | −0.0164 | 0.9219 |
| 46% | −0.0175 | 0.9298 |
| 46% | −0.0188 | 0.9377 |
| 46% | −0.0203 | 0.9455 |
| 46% | −0.0223 | 0.9533 |
| 46% | −0.0247 | 0.9609 |
| 46% | −0.0275 | 0.9684 |
| 46% | −0.0307 | 0.9757 |
| 46% | −0.0343 | 0.9828 |
| 46% | −0.0384 | 0.9896 |
| 46% | −0.0430 | 0.9961 |
| 46% | −0.0481 | 1.0023 |
| 46% | −0.0536 | 1.0080 |
| 46% | −0.0597 | 1.0133 |
| 46% | −0.0660 | 1.0181 |
| 46% | −0.0727 | 1.0225 |
| 46% | −0.0795 | 1.0267 |
| 46% | −0.0864 | 1.0307 |
| 46% | −0.0887 | 1.0350 |

Figure 14:
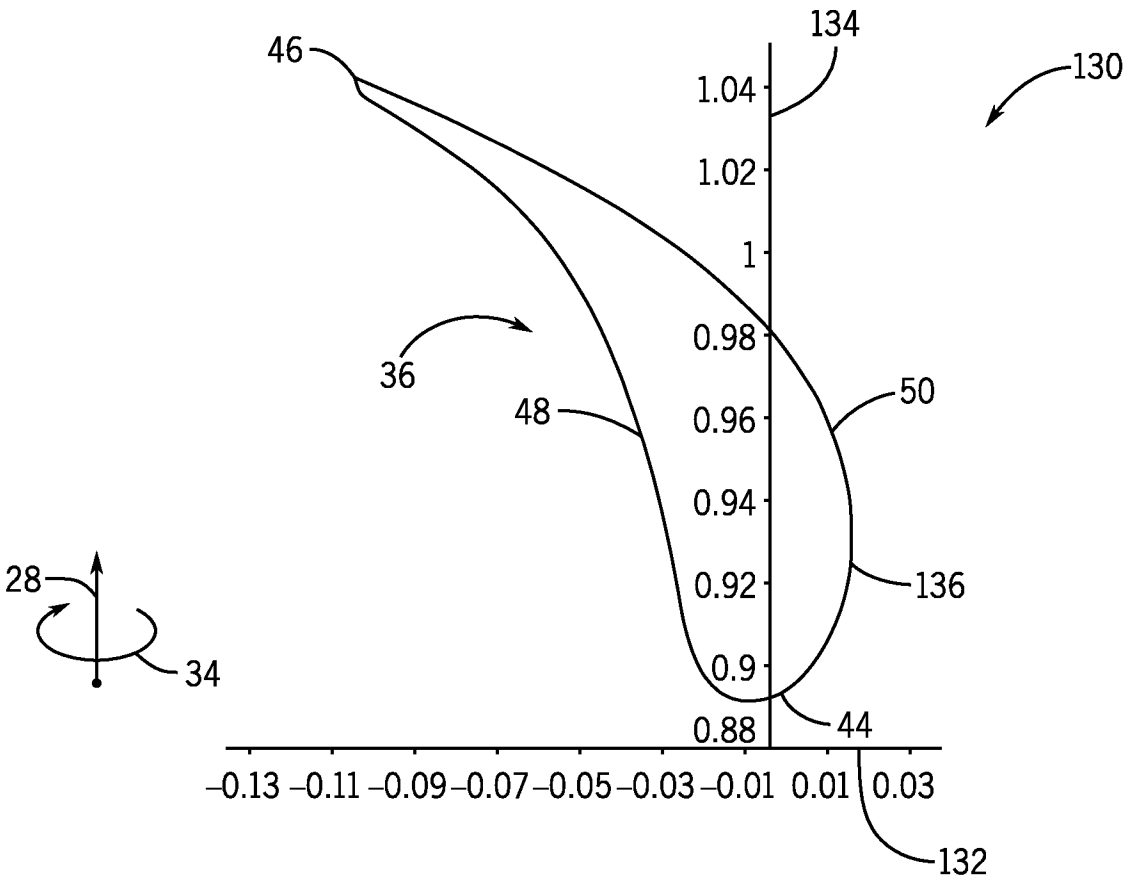
FIG. 14 is a plot of the periphery of a cross section of a nozzle with a suction side bulge at a fourth height in accordance with aspects of the present disclosure.

FIG. 14 is a plot 130 illustrating a cross-sectional view of a periphery or perimeter (indicated by reference numeral 136) of the nozzle 36 at a fourth cross section at approximately 66% span. The horizontal axis of the plot 130 is the y-axis 132 in meters. The vertical axis of the plot 130 is the z-axis 134 in meters and corresponds to the rotational axis 26 shown in FIG. 1. The XZ plane corresponds to the radial plane 30 as shown in FIG. 1. The periphery of the nozzle 36 is represented by a plane at approximately 66% span. Table 4 provides the Y, Z coordinates for 50 points disposed along the periphery or perimeter 136 of the nozzle 36 at a plane located at approximately 66% span.

TABLE 4

| Span | Y | Z |
|---|---|---|
| 66% | −0.1007 | 1.0416 |
| 66% | −0.0929 | 1.0381 |
| 66% | −0.0852 | 1.0347 |
| 66% | −0.0775 | 1.0312 |
| 66% | −0.0699 | 1.0276 |
| 66% | −0.0623 | 1.0238 |

TABLE 4-continued

| Span | Y | Z |
|---|---|---|
| 66% | −0.0547 | 1.0199 |
| 66% | −0.0473 | 1.0159 |
| 66% | −0.0400 | 1.0117 |
| 66% | −0.0328 | 1.0072 |
| 66% | −0.0257 | 1.0025 |
| 66% | −0.0189 | 0.9975 |
| 66% | −0.0123 | 0.9922 |
| 66% | −0.0061 | 0.9865 |
| 66% | −0.0003 | 0.9803 |
| 66% | 0.0050 | 0.9737 |
| 66% | 0.0097 | 0.9667 |
| 66% | 0.0136 | 0.9592 |
| 66% | 0.0167 | 0.9513 |
| 66% | 0.0187 | 0.9431 |
| 66% | 0.0197 | 0.9347 |
| 66% | 0.0196 | 0.9262 |
| 66% | 0.0183 | 0.9179 |
| 66% | 0.0158 | 0.9098 |
| 66% | 0.0119 | 0.9023 |
| 66% | 0.0063 | 0.8960 |
| 66% | −0.0011 | 0.8920 |
| 66% | −0.0094 | 0.8922 |
| 66% | −0.0159 | 0.8974 |
| 66% | −0.0192 | 0.9052 |
| 66% | −0.0213 | 0.9134 |
| 66% | −0.0231 | 0.9217 |
| 66% | −0.0248 | 0.9299 |
| 66% | −0.0266 | 0.9382 |
| 66% | −0.0287 | 0.9464 |
| 66% | −0.0310 | 0.9545 |
| 66% | −0.0337 | 0.9626 |
| 66% | −0.0367 | 0.9705 |
| 66% | −0.0400 | 0.9783 |
| 66% | −0.0438 | 0.9859 |
| 66% | −0.0480 | 0.9932 |
| 66% | −0.0527 | 1.0002 |
| 66% | −0.0581 | 1.0068 |
| 66% | −0.0640 | 1.0128 |
| 66% | −0.0704 | 1.0184 |
| 66% | −0.0772 | 1.0234 |
| 66% | −0.0842 | 1.0281 |
| 66% | −0.0914 | 1.0326 |
| 66% | −0.0986 | 1.0369 |
| 66% | −0.1007 | 1.0416 |

Figure 15:
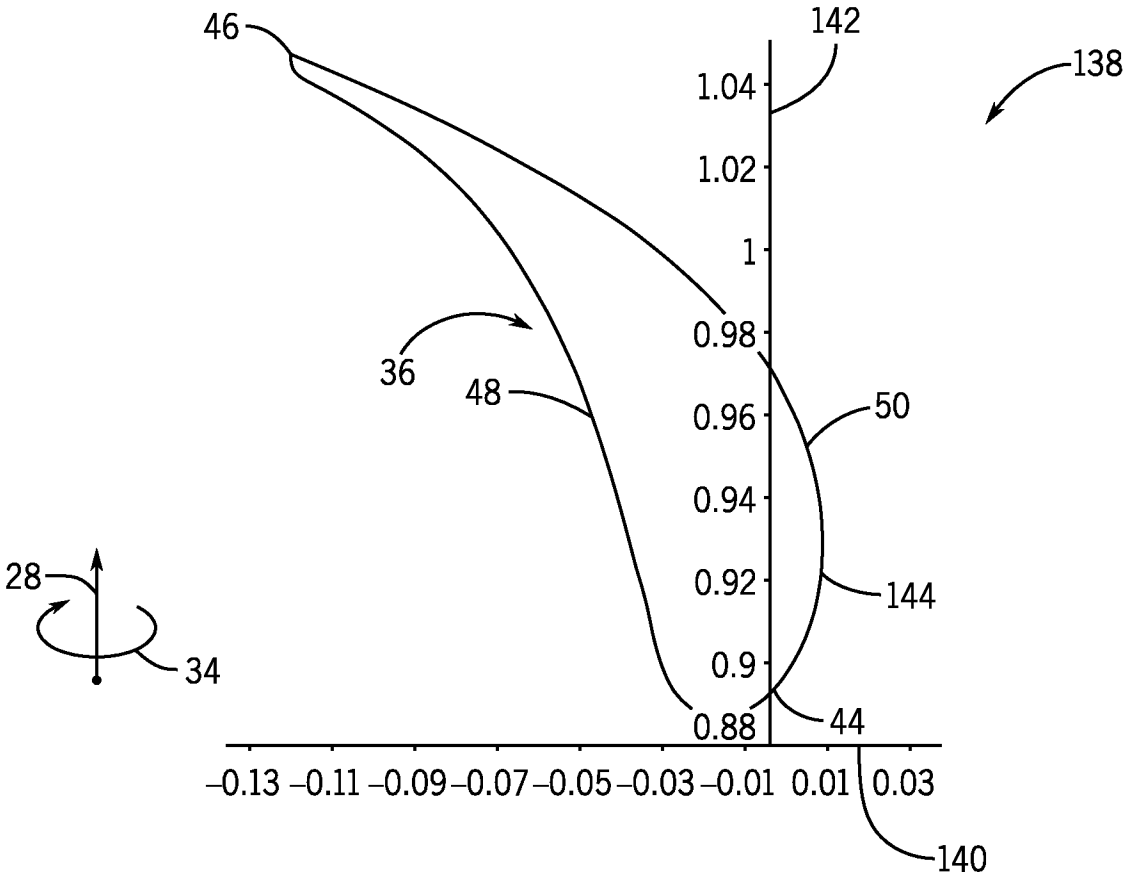
FIG. 15 is a plot of the periphery of a cross section of a nozzle with a suction side bulge at a fifth height in accordance with aspects of the present disclosure.

FIG. 15 is a plot 138 illustrating a cross-sectional view of the periphery or perimeter (indicated by reference numeral 144) of the nozzle 36 at a fifth cross section at approximately 86% span. The horizontal axis of the plot 138 is the y-axis 140 in meters. The vertical axis of the plot 138 is the z-axis 142 in meters and corresponds to the rotational axis 26 shown in FIG. 1. The XZ plane corresponds to the radial plane 30 as shown in FIG. 1. The periphery of the nozzle 36 is represented by a plane located at approximately 86% span. Table 5 provides the Y, Z coordinates for 50 points disposed along the periphery or perimeter 144 of the nozzle 36 at a plane located at approximately 86% span.

TABLE 5

| Span | Y | Z |
|---|---|---|
| 86% | −0.1126 | 1.0481 |
| 86% | −0.1045 | 1.0444 |
| 86% | −0.0963 | 1.0408 |
| 86% | −0.0882 | 1.0370 |
| 86% | −0.0801 | 1.0331 |
| 86% | −0.0722 | 1.0291 |
| 86% | −0.0643 | 1.0249 |
| 86% | −0.0565 | 1.0205 |
| 86% | −0.0489 | 1.0158 |
| 86% | −0.0414 | 1.0110 |
| 86% | −0.0340 | 1.0058 |
| 86% | −0.0270 | 1.0003 |

TABLE 5-continued

| Span | Y | Z |
|---|---|---|
| 86% | −0.0202 | 0.9945 |
| 86% | −0.0138 | 0.9883 |
| 86% | −0.0079 | 0.9816 |
| 86% | −0.0025 | 0.9744 |
| 86% | 0.0022 | 0.9668 |
| 86% | 0.0061 | 0.9588 |
| 86% | 0.0091 | 0.9504 |
| 86% | 0.0111 | 0.9416 |
| 86% | 0.0120 | 0.9328 |
| 86% | 0.0119 | 0.9238 |
| 86% | 0.0106 | 0.9150 |
| 86% | 0.0082 | 0.9064 |
| 86% | 0.0044 | 0.8983 |
| 86% | −0.0010 | 0.8912 |
| 86% | −0.0088 | 0.8870 |
| 86% | −0.0174 | 0.8885 |
| 86% | −0.0232 | 0.8952 |
| 86% | −0.0265 | 0.9035 |
| 86% | −0.0289 | 0.9121 |
| 86% | −0.0310 | 0.9208 |
| 86% | −0.0330 | 0.9295 |
| 86% | −0.0352 | 0.9382 |
| 86% | −0.0376 | 0.9468 |
| 86% | −0.0402 | 0.9553 |
| 86% | −0.0431 | 0.9638 |
| 86% | −0.0464 | 0.9721 |
| 86% | −0.0500 | 0.9803 |
| 86% | −0.0539 | 0.9883 |
| 86% | −0.0583 | 0.9961 |
| 86% | −0.0632 | 1.0036 |
| 86% | −0.0686 | 1.0107 |
| 86% | −0.0746 | 1.0173 |
| 86% | −0.0812 | 1.0233 |
| 86% | −0.0883 | 1.0288 |
| 86% | −0.0957 | 1.0338 |
| 86% | −0.1032 | 1.0386 |
| 86% | −0.1109 | 1.0432 |
| 86% | −0.1126 | 1.0481 |

Note that the suction side bulge can be seen in FIGS. 12 and 13. Additionally, the pressure side tilt can be seen as the plots of the periphery of the nozzle 36 shift in the negative y direction, toward the pressure side 48 as the cross sections progress from the first annular wall 40 to the second annular wall 42.

Figure 16:
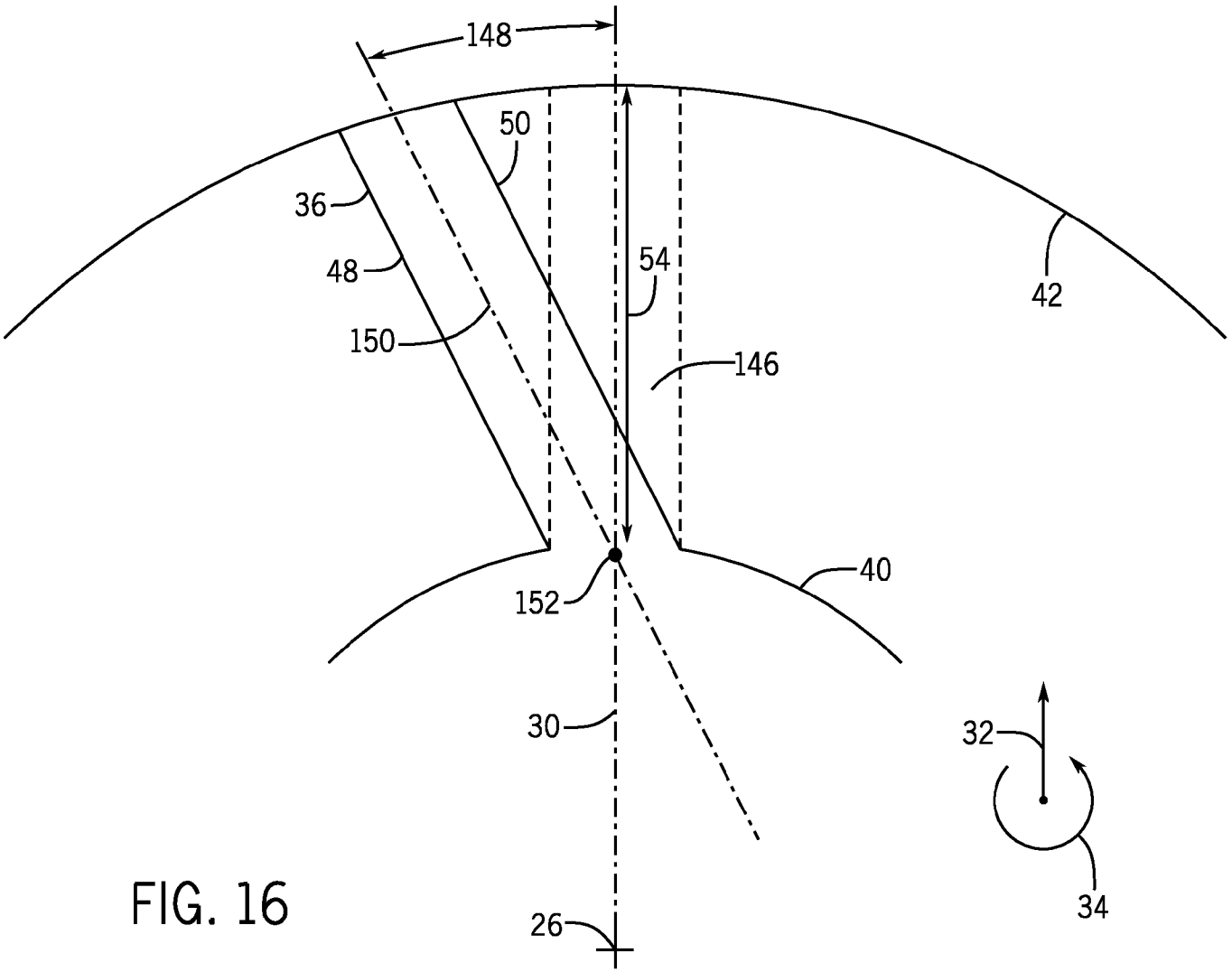
FIG. 16 is a schematic of a nozzle tilted toward the pressure side relative to a radially stacked airfoil in accordance with aspects of the present disclosure.

As discussed with regard to FIGS. 11-15, in some embodiments, the nozzle 36 may be tilted or angled to the pressure side 48, as compared to a radially stacked airfoil 146. FIG. 16 shows a schematic of nozzle 36 angled toward the pressure side 48 as compared to a radially stacked airfoil 146. That is, the nozzle 36 may have an angle of tilt 148 toward the pressure side 48 (i.e., in the circumferential direction 34) from the radial plane 30. Note that FIG. 16 is not to scale, and for the sake of clarity, may show more or less tilt 148 than may be found in some embodiments. Note that the radially stacked airfoil 146 has a longitudinal axis that extends in the radial direction 32, along the radial plane 30, and may intersect with the rotational axis 26 of the turbine 16. In contrast, the longitudinal axis 150 of the nozzle 36 may be angled toward the pressure side 48 of the nozzle 36 from the radial plane 30 by an angle 148. The longitudinal axis 150 of the nozzle may intersect with the radial plane 30 at a point 152 at or near the first annular wall 40, and may not intersect the rotational axis 26 of the turbine 16.

Figure 17:
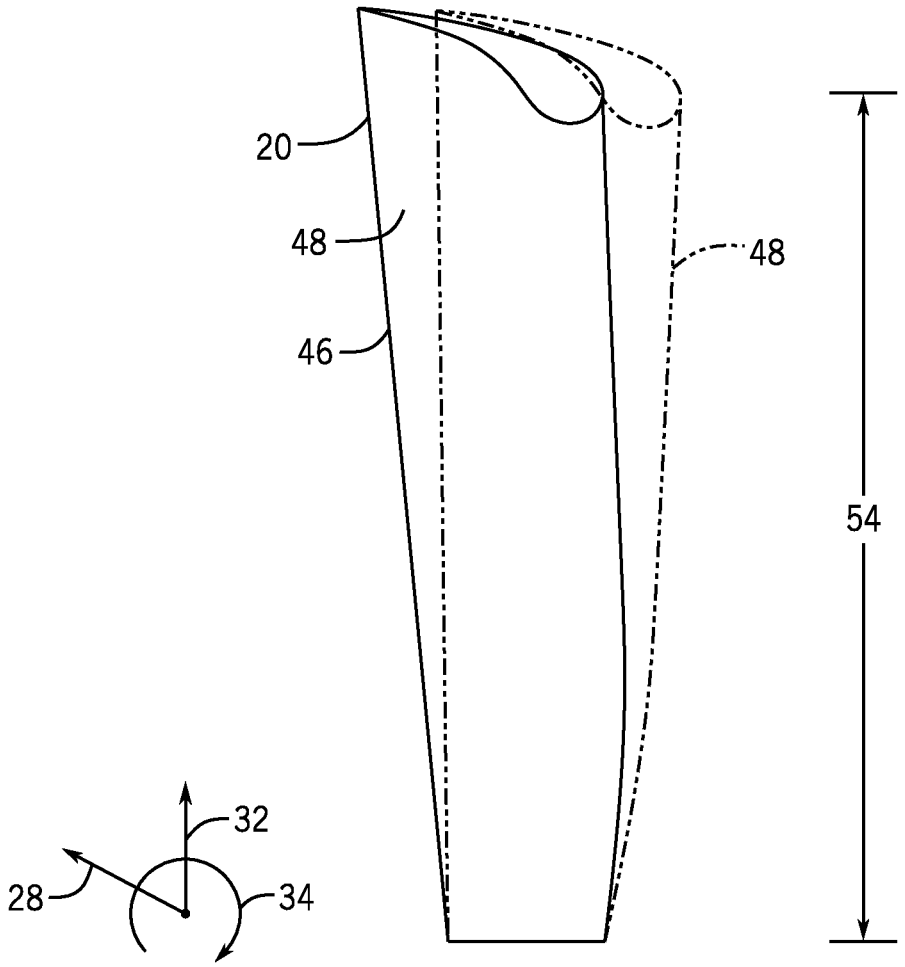
FIG. 17 is a perspective view of a nozzle with a 3 degree pressure side tilt as compared to a radially stacked airfoil in accordance with aspects of the present disclosure.

FIG. 17 shows a perspective view of nozzle 36 with approximately 3 degrees of pressure side 48 tilt 148 as compared to a radially stacked airfoil 146. That is, the nozzle 36 may tilt 3 degrees toward the pressure side 48 (i.e., in the circumferential direction 34) from the radial plane 30. The tilt 148 may be anywhere between 0-5 degrees. In the embodiment shown in FIG. 17, the pressure side 48 tilt 148 is 3 degrees. However, it should be understood that the tilt 148 may be any degree of tilt toward the pressure side 48 between approximately 0 and 5 degrees. A nozzle 36 with pressure side 48 tilt 148 exerts body forces on the fluid passing through the stage 24, pushing the fluid in the radial direction toward the hub. Pushing the fluid toward the hub increases root reaction. Thus, the nozzle 36 with the suction side 50 bulge 52 and the pressure side 48 tilt 148 increases root reaction in the last blade stage 20, which reduces secondary flows and swirling, increasing the efficiency of the last blade stage 20, and increasing the performance of the diffuser.

Technical effects of the disclosed embodiments include a reduction of both secondary flows and undesirable swirling. In some embodiments, the disclosed techniques may improve the performance of the last blade stage by approximately 200 KW or more, and may improve diffuser performance by approximately 1500 KW or more, for a total benefit of approximately 1700 KW or more. It should be understood, however, that benefits resulting from implementation of the disclosed techniques may vary from turbomachine to turbomachine.

This written description uses examples to disclose the claimed subject matter, including the best mode, and also to enable any person skilled in the art to practice the subject matter, including making and using any devices or systems and performing any incorporated methods. The patentable scope of the claimed subject matter is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A turbine nozzle configured to be disposed in a turbine comprising:

a suction side extending between a leading edge of the turbine nozzle and a trailing edge of the turbine nozzle in an axial direction and transverse to a longitudinal axis of the turbine nozzle, and extending a height of the turbine nozzle in a radial direction along the longitudinal axis;

a pressure side disposed opposite the suction side and extending between the leading edge of the turbine nozzle and the trailing edge of the turbine nozzle in the axial direction, and extending the height of the turbine nozzle in the radial direction; and a bulge disposed on the suction side of the turbine nozzle protruding from the suction side in a direction transverse to both the radial and axial directions;

wherein the turbine nozzle has a first periphery defined at a first cross-section at a first location along the height of the turbine nozzle by selected coordinate sets listed in Table 1.

2. The turbine nozzle of claim 1, wherein the turbine nozzle has a second periphery defined at a second cross-section at a second location along the height of the turbine nozzle different from the first location by selected coordinate sets listed in Table 2.

3. The turbine nozzle of claim 2, wherein the turbine nozzle has a third periphery defined at a third cross-section at a third location along the height of the turbine nozzle different from both the first and second locations by selected coordinate sets listed in Table 3.

4. The turbine nozzle of claim 3, wherein the turbine nozzle has a fourth periphery defined at a fourth cross-section at a fourth location along the height of the turbine nozzle different from the first, second, and third locations by selected coordinate sets listed in Table 4.

5. The turbine nozzle of claim 4, wherein the turbine nozzle has a fifth periphery defined at a fifth cross-section at a fifth location along the height of the turbine nozzle different from the first, second, third, and fourth locations by selected coordinate sets listed in Table 5.

6. The turbine nozzle of claim 5, wherein the bulge begins to protrude at a starting height at a first percentage of the height of the nozzle, reaches a maximum protrusion at a second percentage of the height of the nozzle, and ceases to protrude at an ending height at a third percentage of the height of the nozzle.

7. The turbine nozzle of claim 1, wherein the bulge extends at least more than half of a length of the suction side between the leading edge and the trailing edge.

8. The turbine nozzle of claim 1, wherein the bulge extends along an entire length of the suction side.

9. The turbine nozzle of claim 1, wherein the nozzle has a tilt to the pressure side relative to a plane that extends from a rotational axis of the turbine in the radial direction.

10. The turbine nozzle of claim 9, wherein the tilt to the pressure side is greater than 0 degrees and equal to or less than 5 degrees.

11. A system, comprising:

a turbine, comprising:

a first annular wall;

a second annular wall; and a last stage comprising a plurality of nozzles disposed annularly between the first and second annular walls about a rotational axis of the turbine, wherein each nozzle of the plurality of nozzles comprises:

a height extending between the first and second annular walls;

a leading edge;

a trailing edge disposed downstream of the leading edge;

a suction side extending between the leading edge and the trailing edge in an axial direction, and extending the height of the nozzle in a radial direction;

a pressure side disposed opposite the suction side and extending between the leading edge of the nozzle and the trailing edge of the nozzle in the axial direction, and extending the height of the nozzle in the radial direction;

a bulge disposed on the suction side of the nozzle that protrudes in a direction transverse to a radial plane extending from the rotational axis; and a first periphery defined at a first cross-section at a first location along the height of each nozzle of the plurality of nozzles by selected coordinate sets listed in Table 1.

12. The system of claim 11, wherein each nozzle of the plurality of nozzles comprises a second periphery defined at a second cross-section at a second location along the height of each nozzle of the plurality of nozzles different from the first location by selected coordinate sets listed in Table 2.

13. The system of claim 12, wherein each nozzle of the plurality of nozzles comprises a third periphery defined at a third cross section at a third location along the height of each nozzle of the plurality of nozzles different from both the first and second locations by selected coordinate sets listed in Table 3.

14. The system of claim 13, wherein each nozzle of the plurality of nozzles comprises a fourth periphery defined at a fourth cross section at a fourth location along the height of each nozzle of the plurality of nozzles different from the first, second, and third locations by selected coordinate sets listed in Table 4.

15. The system of claim 14, wherein each nozzle of the plurality of nozzles comprises a fifth periphery defined at a fifth cross section at a fifth location along the height of each nozzle of the plurality of nozzles different from the first, second, third, and fourth locations by selected coordinate sets listed in Table 5.

16. The system of claim 11, wherein the leading edge and the trailing edge have a tilt toward the pressure side relative to the radial plane extending from the rotational axis in the radial direction.

17. The system of claim 16, wherein each nozzle of the plurality of nozzles is angled to the pressure side by 3 degrees relative to the radial plane.

18. The system of claim 11, wherein the maximum protrusion of the bulge is between 0.5% and 5.0% of the height of the nozzle.

19. The system of claim 11, wherein the maximum protrusion of the bulge occurs between 20% and 40% of the height of the nozzle.

20. A system, comprising:

a turbine, comprising:

a first annular wall;

a second annular wall; and a last stage comprising a plurality of nozzles disposed annularly between the first and second annular walls about a rotational axis of the turbine, wherein each nozzle of the plurality of nozzles comprises:

a height between the first and second annular walls;

a leading edge;

a trailing edge disposed downstream of the leading edge;

a suction side extending between the leading edge and the trailing edge in an axial direction, and extending the height of the nozzle in a radial direction;

a pressure side disposed opposite the suction side and extending between the leading edge of the nozzle and the trailing edge of the nozzle in the axial direction, and extending the height of the nozzle in the radial direction;

a bulge disposed on the suction side of the nozzle that protrudes in a direction transverse to a radial plane extending from the rotational axis; and a first periphery defined at a first cross section at a first location along the height of each nozzle of the plurality of nozzles by selected coordinate sets listed in Table 1;

a second periphery defined at a second cross section at a second location along the height of each nozzle of the plurality of nozzles different from the first location by selected coordinate sets listed in Table 2;

a third periphery defined at a third cross section at a third location along the height of each nozzle of the plurality of nozzles different from both the first and second locations by selected coordinate sets listed in Table 3;

a fourth periphery defined at a fourth cross section at a fourth location along the height of each nozzle of the plurality of nozzles different from the first, second, and third locations by selected coordinate sets listed in Table 4; and a fifth periphery defined at a fifth cross section at a fifth location along the height of each nozzle of the plurality of nozzles different from the first, second, third, and fourth locations by selected coordinate sets listed in Table 5;

wherein each nozzle of the plurality of nozzles is angled relative to the radial plane toward the pressure side.

* * * * *